US009115505B2

(12) United States Patent
Magnus

(10) Patent No.: US 9,115,505 B2
(45) Date of Patent: Aug. 25, 2015

(54) NOSEMOUNT SEATING SYSTEM

(75) Inventor: Tyler N. Magnus, St. Peter, IL (US)

(73) Assignee: Irwin Seating Company, Grand Rapids, MI (US)

( * ) Notice: Subject to any disclaimer, the term of this patent is extended or adjusted under 35 U.S.C. 154(b) by 260 days.

(21) Appl. No.: 13/549,709

(22) Filed: Jul. 16, 2012

(65) Prior Publication Data

US 2013/0019540 A1 Jan. 24, 2013

Related U.S. Application Data

(60) Provisional application No. 61/510,720, filed on Jul. 22, 2011.

(51) Int. Cl.

| | |
|---|---|
| ***E04H 3/12*** | (2006.01) |
| ***E04H 3/30*** | (2006.01) |
| *A47C 1/12* | (2006.01) |

(52) U.S. Cl.

CPC . *E04H 3/126* (2013.01); *A47C 1/12* (2013.01); *E04H 3/30* (2013.01)

(58) Field of Classification Search

CPC ..... E04H 3/126; E04H 3/123; E04H 3/22; E04H 3/24; E04H 3/30; A47C 1/126; A47C 1/12; A47C 7/407

USPC ..... 52/6–10; 297/217.7; 182/223; 472/92; 403/256, 257, 241

See application file for complete search history.

(56) References Cited

U.S. PATENT DOCUMENTS 4,000,586 A * 1/1977 Vance et al. ..... 52/9
4,063,392 A * 12/1977 Van Ryn et al. ..... 52/9
4,155,202 A * 5/1979 Hartman ..... 52/9
4,446,659 A * 5/1984 Quigley ..... 52/9
4,557,080 A * 12/1985 Walworth et al. ..... 52/9
5,228,739 A * 7/1993 Love ..... 296/100.02
5,328,238 A * 7/1994 Yamazaki ..... 297/332
5,570,931 A * 11/1996 Kargilis et al. ..... 297/378.12

(Continued)

FOREIGN PATENT DOCUMENTS

WO 7900872 A1 11/1979
WO 8000359 A1 3/1980

OTHER PUBLICATIONS

Brochure entitled "Chair Platform Seating" by Irwin Telescopic Seating Company, copyright 2009.

(Continued)

*Primary Examiner* — Elizabeth A Plummer
*Assistant Examiner* — Kyle Walraed-Sullivan
(74) *Attorney, Agent, or Firm* — Gardner, Linn, Burkhart & Flory, LLP

(57) ABSTRACT

A bleacher seating system provides a seatback locking and release mechanism that allows for rapid simultaneous repositioning of the seat back portions in each row of seating to aid in setting up and collapsing sets of seating rows. The locking and release mechanism may be actuated to substantially simultaneously unlock all seat back portions in a row from a single location. The bleacher seating system may be readily set up or collapsed by a single operator, such as by manually or remotely unlocking and locking the seat back portions in rows so that the seat backs may be pivoted between raised and lowered positions. In addition, deck nosemount clamps allow for increased walking space behind the seats and a particularly compact seating storage configuration.

20 Claims, 12 Drawing Sheets

(56) References Cited

U.S. PATENT DOCUMENTS

| | | | | |
|---|---|---|---|---|
| 6,185,875 | B1 | 2/2001 | Victor et al. | |
| 6,428,097 | B1 * | 8/2002 | Amemiya et al. | 297/217.7 |
| 7,172,245 | B2 * | 2/2007 | Bouchard et al. | 297/217.7 |
| 7,337,583 | B1 * | 3/2008 | Lohman et al. | 52/9 |
| 7,617,635 | B2 | 11/2009 | Jacobs et al. | |
| 7,901,004 | B2 * | 3/2011 | Figueras Mitjans | 297/257 |
| 7,905,546 | B2 * | 3/2011 | Conner | 297/217.7 |
| 8,056,974 | B2 * | 11/2011 | Conner | 297/217.7 |
| 8,490,335 | B2 * | 7/2013 | LaForest | 52/8 |
| 2008/0190038 | A1 * | 8/2008 | Jacobs et al. | 52/9 |
| 2011/0016798 | A1 | 1/2011 | Jacobs et al. | |
| 2011/0067316 | A1 * | 3/2011 | Ortner | 52/9 |

OTHER PUBLICATIONS

Brochure entitled "Rally: Extraordinary Seating Solutions for Any Event" by American Seating Company, copyright 2011.

International Search Report and Written Opinion dated Jan. 30, 2013, from International Application No. PCT/US2012/046897.

* cited by examiner

NOSEMOUNT SEATING SYSTEM

CROSS REFERENCE TO RELATED APPLICATION

The present application claims the benefit of U.S. provisional application Ser. No. 61/510,720, filed. Jul. 22, 2011, which is hereby incorporated herein by reference in its entirety.

FIELD OF THE INVENTION

The present invention relates to bleacher seating systems that are typically extendable and retractable, and that have collapsible seatbacks for compact storage when the bleacher seating system is not in use.

BACKGROUND OF THE INVENTION

Sporting and exhibition facilities often include bleacher-style seating systems to provide spectators with unobstructed views of a sporting event or other activity taking place at the venue. Indoor venues in particular, such as gymnasiums, stadiums, arenas and the like, are often used for different types of events, such that it may be desirable to provide a collapsible bleacher system that at least partially retracts against or into a wall or perimeter region of the venue. It is often desirable to provide collapsible seatbacks that are movable to a lowered, storage position in which the individual seats assume a low profile to facilitate compact storage of the seating system.

SUMMARY OF THE INVENTION

The present invention provides a bleacher seating system having a plurality of movable decks that support respective rows of seats having seatbacks that can be substantially simultaneously locked in an upright use configuration, and that can be substantially simultaneously unlocked and lowered to a low profile storage configuration. Each row of seats is coupled to a respective deck via seat mounting brackets, with a release mechanism that allows an operator to simultaneously lock and release all of the seatbacks in a given row, from a single location. The release mechanism includes an actuator bar that extends along and between the seat mounting brackets, with release members spaced along the actuator bar for selectively engaging seatback brackets corresponding to each seat in the row. In this way, a single operator can simultaneously collapse all of the seatbacks in a row from a single location, rather than individually unlocking and lowering each seatback. In addition, the present invention provides a deck clamp at each seat mounting bracket for coupling the seats to a forward edge or nose portion of the deck. This mounting arrangement allows for increased surface area of the deck for walking and leg room, while also allowing for a lower profile of the seats when in the stored or collapsed configuration.

According to one aspect of the present invention, a bleacher seating system includes a generally planar deck having a forward edge portion, a plurality of seats arranged in a row along the deck, a plurality of seat mounting brackets, and a deck clamp at each of the brackets. The deck clamp is configured to releasably engage the forward edge portion of the deck to couple the seats to the deck, whereby the seats are supported at the forward edge portion of the deck via the deck clamps.

Optionally, the forward edge portion of the deck includes upper and lower flanges, each of which can be engaged by respective portions of the deck clamp.

According to another aspect of the present invention, a bleacher seating system includes a deck, a plurality of seats arranged in a row along the deck, an elongate actuator bar, a seatback bracket for each of the seats, and a plurality of release members coupled to the actuator bar. The seats are coupled to the deck via respective seat mounting brackets, and each seat includes a seat portion and a pivotable back portion. The back portion of the seat is movable between a locked upright use position and an unlocked collapsed storage position. The seatback bracket pivotably couples the back portion of each seat to a respective seat mounting bracket. Each seatback bracket includes a pivot-lock element for selective engagement by a respective release member along the actuator bar. The release members are coupled to the actuator bar in spaced arrangement, and extend outwardly from the bar, which extends between and is rotatably supported at the seat mounting brackets along the seating row. The release members rotate with the actuator bar, and are generally aligned with respective seatback brackets. The actuator bar and its release members are rotatable to a locking position in which the release members along the actuator bar engage respective pivot lock elements on the seatback brackets, to limit or prevent pivoting movement of the seatback bracket when it is in the use position. The actuator bar and release members are further rotatable to an unlocking position in which the release members disengage the respective pivot-lock elements, to permit pivoting movement of the seatback bracket and the back portion to the collapsed storage position.

Optionally, the pivot-lock elements of the seatback brackets are in the form of recesses, and the release members along the actuator bar include projections for selectively engaging the recesses when the release members are in the locking position.

Optionally, an actuator lever is coupled to an end portion of the elongate actuator bar, and extends outwardly therefrom. An actuator, such as a linear actuator or the like, may be provided to move the actuator lever, so that an operator can remotely rotate the actuator bar and release members to simultaneously release the pivotable back portions in a given row of seats to the collapsed storage position.

Optionally, a damper or biasing element, or a combined damper and biasing element, may be coupled between the seatback bracket and the seat mounting bracket to slow the movement of the seatback bracket and seat back portion to the collapsed storage position, and/or to assist in raising the seatback bracket and seat back portion away from the storage position.

Optionally, each of the seat mounting brackets includes a deck clamp that couples the seats to a forward edge portion of the deck. The deck clamps may be generally C-shaped clamps, each with two separable clamp portions that are joined together by a fastener. The two clamp portions are securable to the forward edge portion of the deck via tightening of the fastener, and may be positioned at substantially any desired spacing along the deck.

Therefore, the present invention provides for the rapid unlocking and collapsing of seatbacks in a bleacher seating system so that the decks can be quickly retracted to a compact storage configuration. All of the seatbacks in a given row of seats can be collapsed simultaneously or substantially simultaneously via actuation of a single lever or other actuator, and the seatbacks can also be simultaneously or substantially simultaneously locked in a raised use configuration to provide seating for spectators of an event. An operator may thus simultaneously collapse each seatback portion along a given row of seats from a single location, which simplifies and reduces the time required to raise and lower seatbacks during the setup and retraction processes. Also, by using nosemount deck clamps, the height of each seating row with seatbacks in the lowered or collapsed positions can be reduced to provide for a particularly compact storage configuration of the bleacher seating system, while also allowing for increased walking space along the deck behind the seats. The clamp-on configuration of the present invention provides enhanced mounting of the seats to the deck and allows the seat system manufacturer to select or designate a seat width or size at each location, with the seating brackets spaced according to the selected seat width.

These and other objects, advantages, purposes, and features of the present invention will become apparent upon review of the following specification in conjunction with the drawings.

DESCRIPTION OF THE PREFERRED EMBODIMENTS

Figure 1:
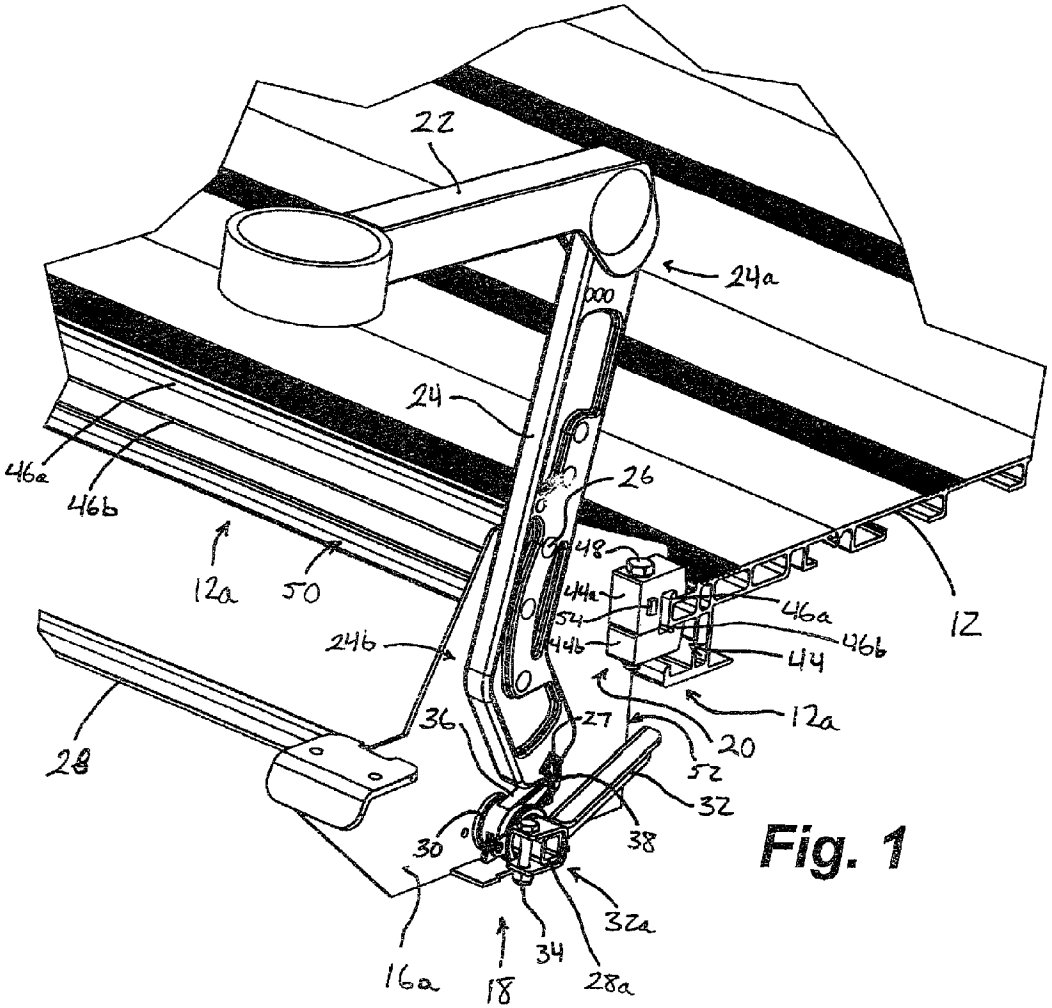
FIG. 1 is an enlarged perspective view of a seating attachment and seatback pivoting and release mechanism in accordance with the present invention, shown with a seatback bracket in the raised and locked configuration.
Figure 2:
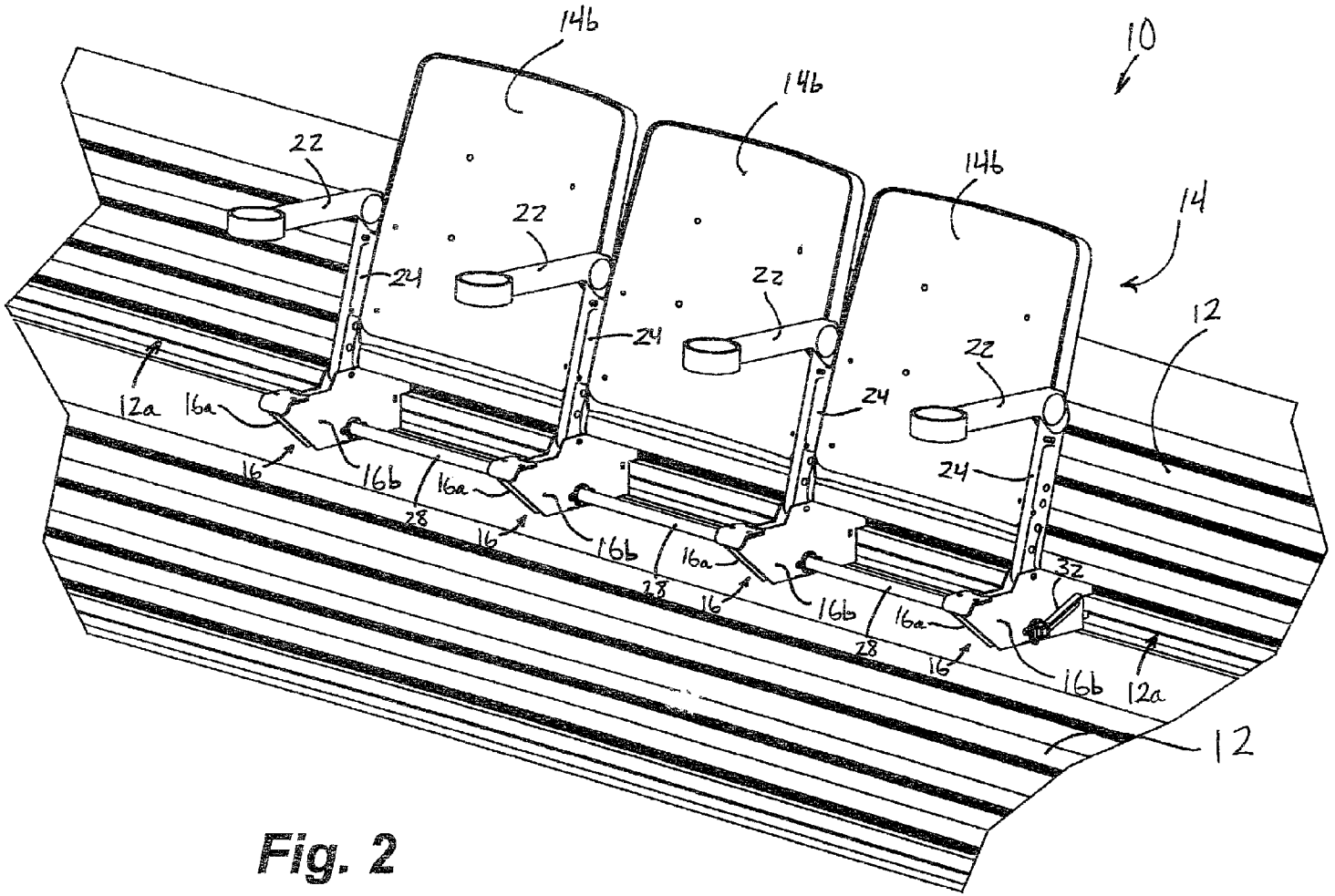
FIG. 2 is a perspective view of three bleacher seats arranged in a row along a deck, with raised back portions and with seat portions removed for clarity.
Figure 9:
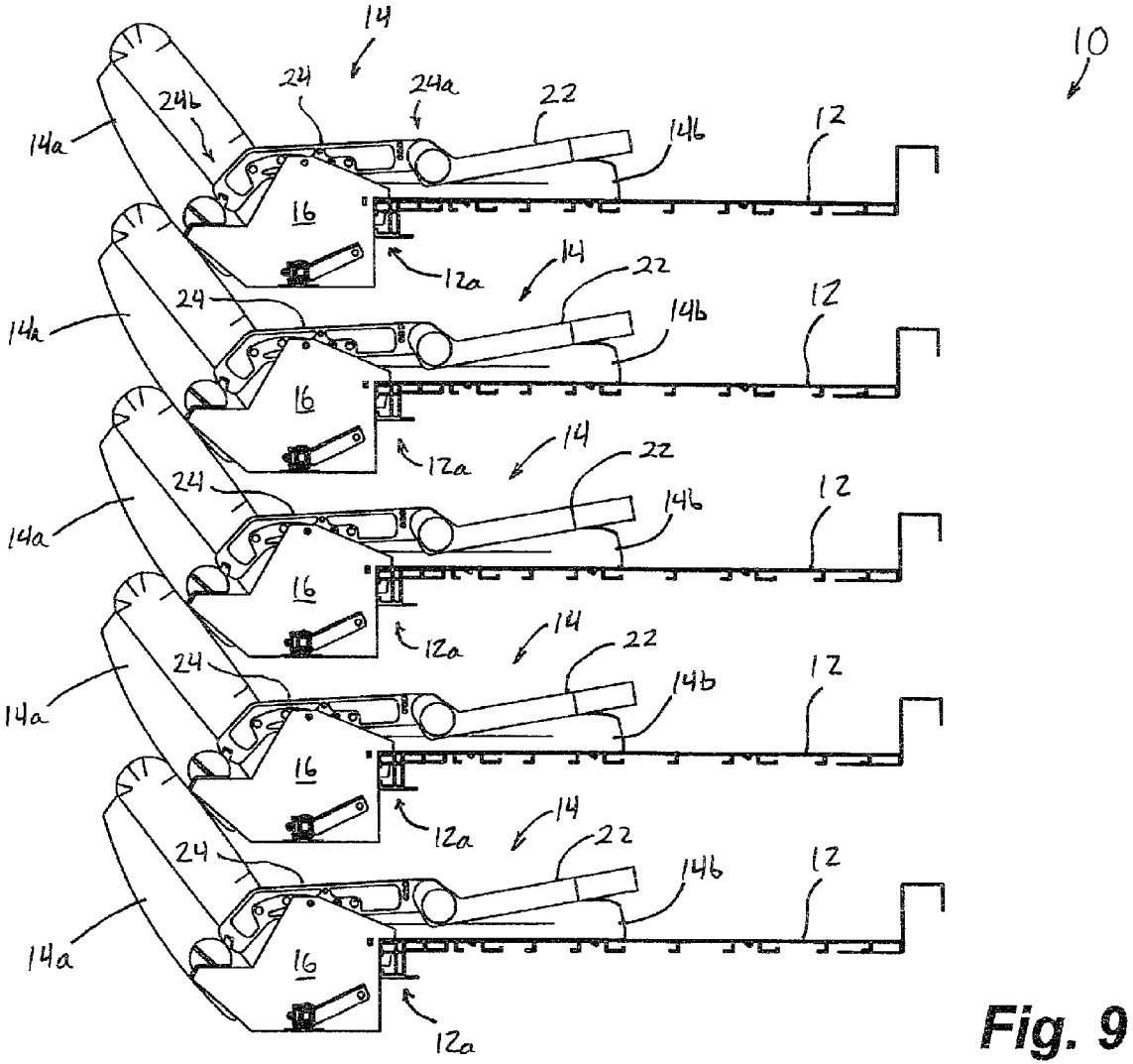
FIG. 9 is a side elevation of a bleacher seating system including five decks and respective rows of seats in their collapsed, stored configuration.
Figure 10:
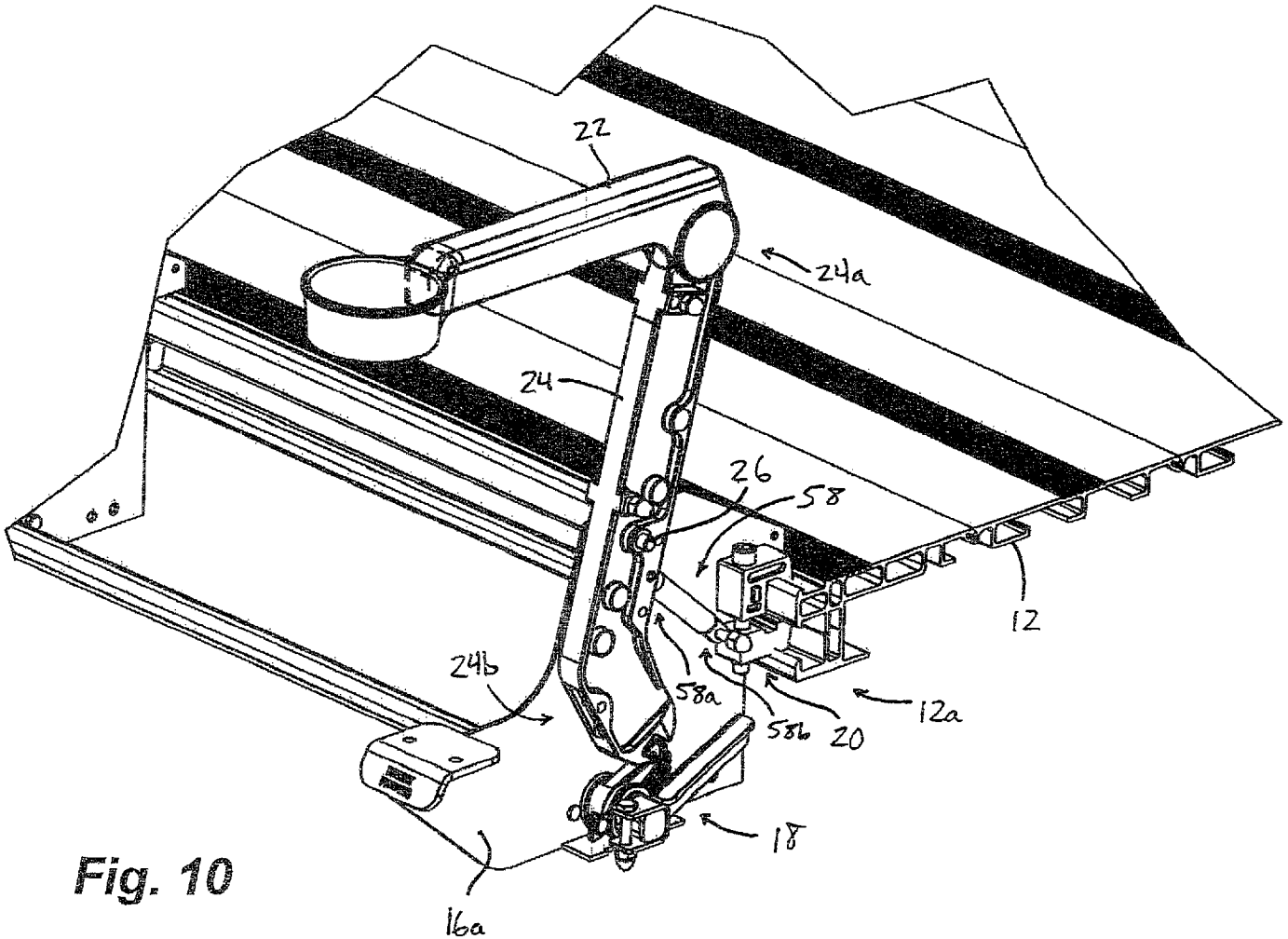
FIG. 10 is an enlarged perspective view of another seatback pivoting and release mechanism including a damper in accordance with the present invention, shown with a seatback bracket in the raised and locked configuration.
Figure 11:
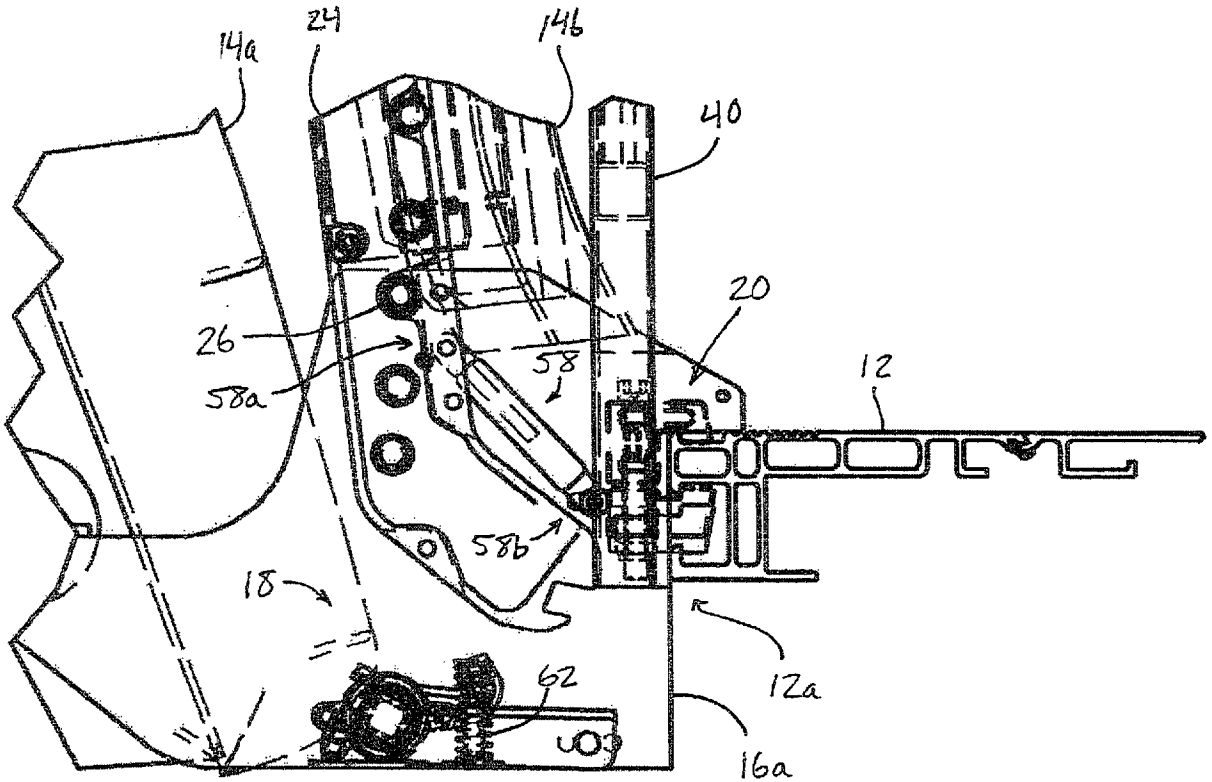
FIG. 11 is a side elevation of the seatback pivoting and release mechanism of FIG. 10, including a seat portion, and with the back portion in an unlocked and fully upright position.
Figure 12:
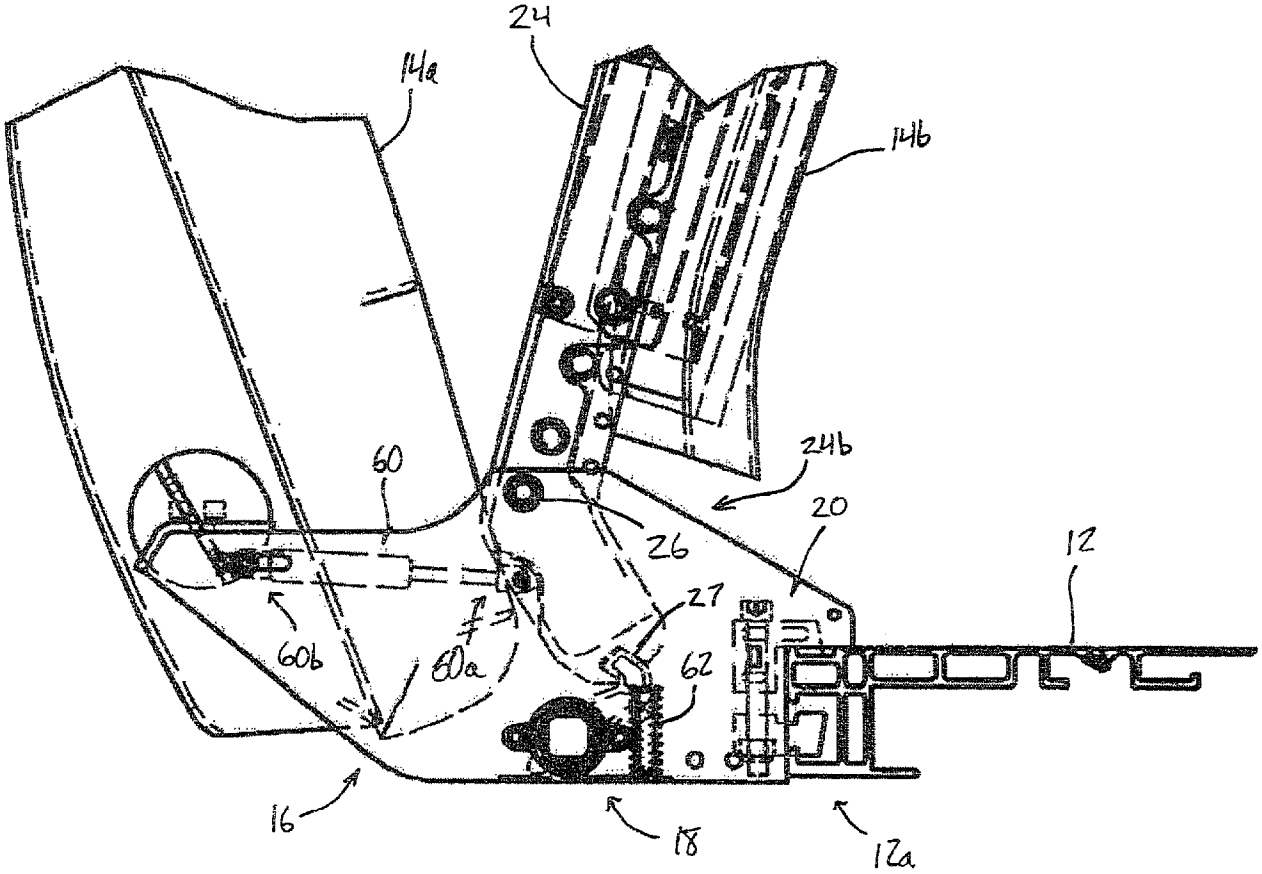
FIG. 12 is a side elevation of another seatback pivoting and release mechanism including a damper in accordance with the present invention.

Referring now to the drawings and the illustrative embodiments depicted therein, a bleacher seating system 10 includes a plurality of decks 12, each having a row of seats 14 mounted thereon (FIGS. 2 and 9). Each row of seats 14 is coupled to a front edge or nose portion 12*a* of a respective deck 12 via seat mounting bracket assemblies 16, which further support a release mechanism 18 (FIGS. 1, 4, 5 and 7). Each seat mounting bracket assembly 16 includes a deck clamp 20 (FIGS. 1, 5 and 7) for securing each row of seats 14 to front edge portion 12*a* of deck 12. As will be described in more detail below, release mechanism 18 allows a single operator to simultaneously lock seat back portions 14*b* in the raised configuration, and to simultaneously unlock and lower seat back portions 14*b* to a compact storage configuration.

Figure 3:
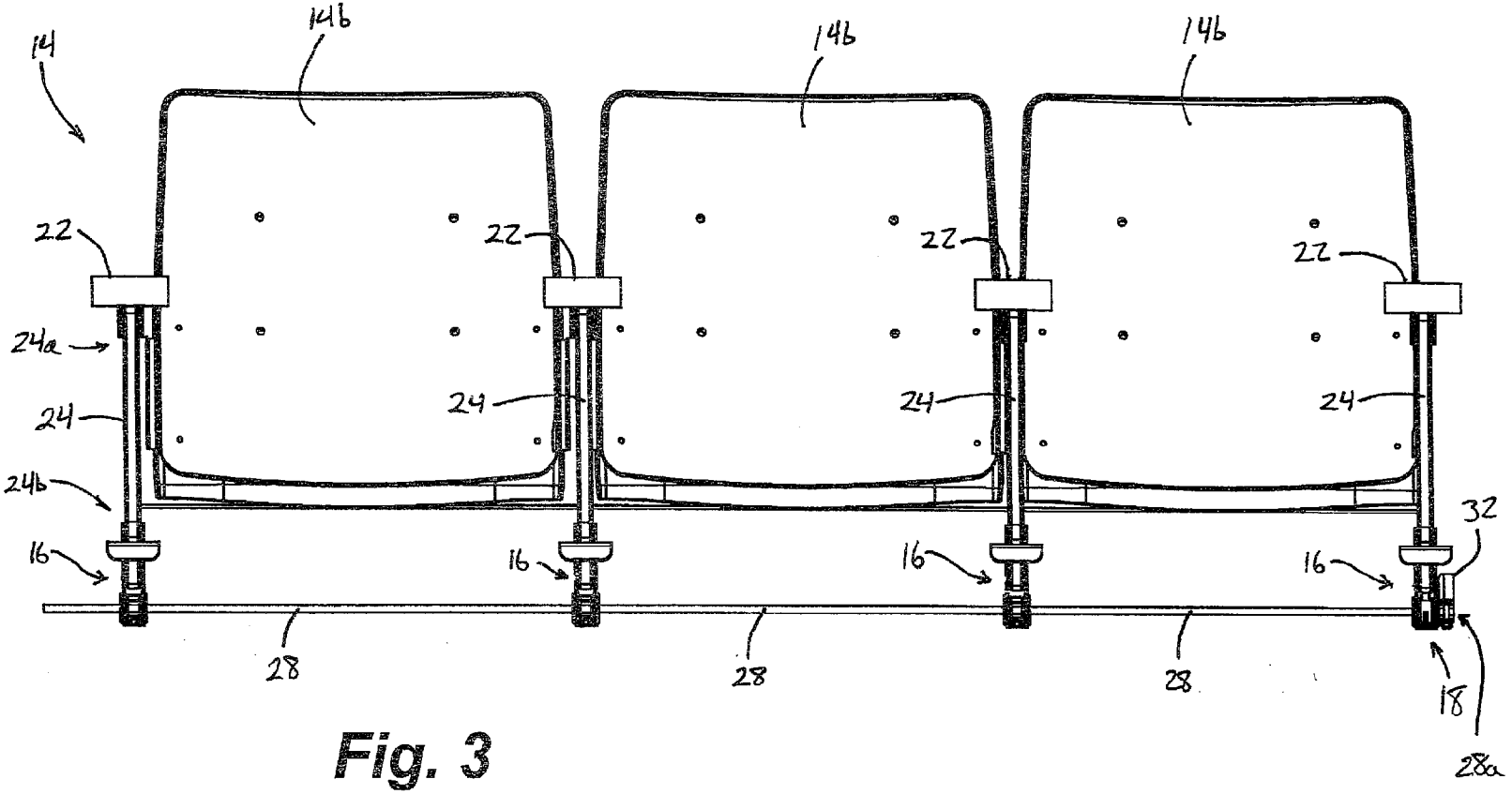
FIG. 3 is a front elevation of the bleacher seats of FIG. 2, with decks removed for clarity.
Figure 7:
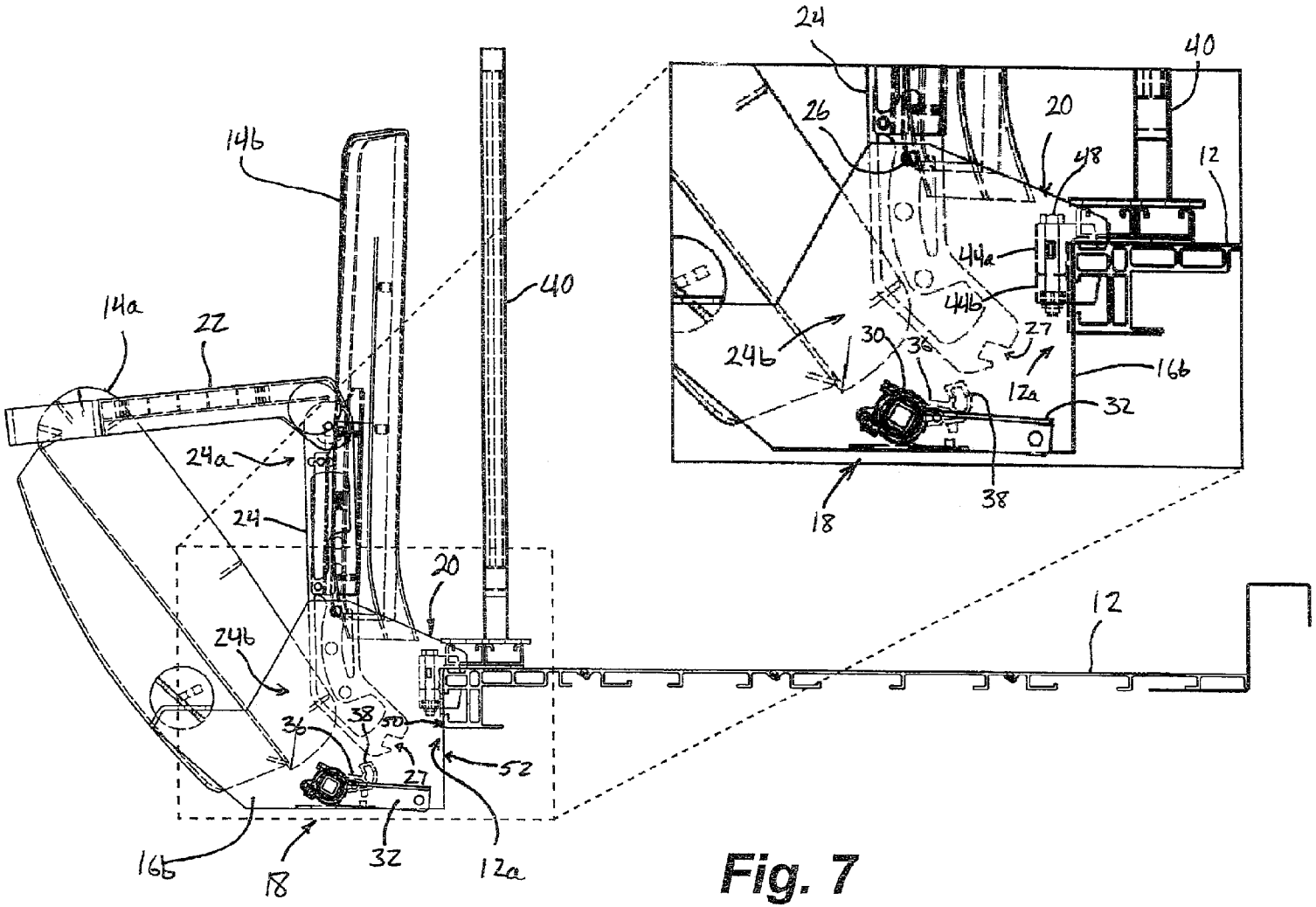
FIG. 7 is a side elevation of another bleacher seat including a seat portion in a semi-upright position, a back portion in an unlocked and fully upright position, and a spectator rail positioned behind the back portion, and further including an enlarged view of the seat mounting and seatback release mechanism.
Figure 8:
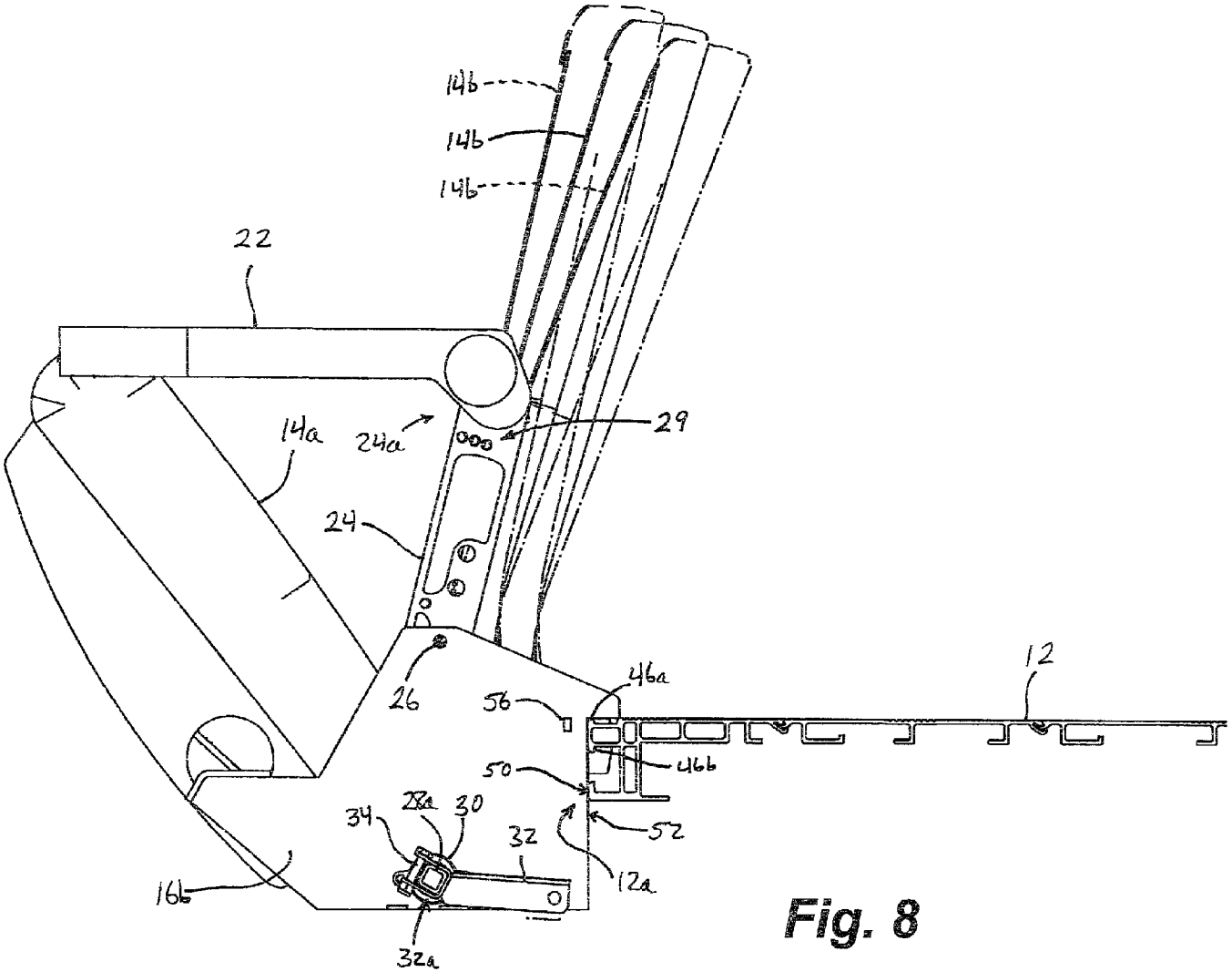
FIG. 8 is a side elevation of a bleacher seat, depicting three seatback recline positions.

Each seat 14 is supported between a pair of seat mounting bracket assemblies 16, each of which includes a spaced pair of substantially identical bracket plates 16*a*, 16*b* (FIG. 2). Each seat 14 further includes a pair of armrests 22 pivotably supported at upper end portions 24*a* of respective seatback brackets 24. Seatback brackets 24 have lower end portions 24*b* that are pivotably coupled to seat mounting brackets 16 (between bracket plates 16*a*, 16*b*). As shown in FIGS. 2 and 3, some of the seat mounting bracket assemblies 16 and seatback brackets 24 are located between adjacent seats 14, and are shared by those seats. Each seatback bracket 24 is pivotably coupled at its lower end portion 24*b* to a respective seat mounting bracket assembly 16 via a pivot pin 26 (FIGS. 1, 7 and 8). Lower end portion 24*b* of seatback bracket 24 includes a pivot-lock element in the form of a recess 27. Seat portions 14*a* are pivotably coupled to seat mounting brackets 16, and may be spring-biased to a raised storage configuration in a substantially conventional manner when they are not in use (FIGS. 7-9).

Optionally, bracket assemblies 16 may be sized and configured for use in bleacher seating having a relatively large or steep slope by using increased-height bracket plates 16*a*, 16*b* (FIGS. 1 and 7-11), or may be sized and configured for use in bleacher seating having a relatively small or shallow slope by using decreased-height bracket plates 16*a*, 16*b* (FIGS. 2-6), without departing from the spirit and scope of the present invention. For example, the bracket plates of FIGS. 1 and 7-11 may be sized for use with decks at 16-inch vertical spacing, while the bracket plates of FIGS. 2-6 and 12 may be sized for use with decks at 7.5-inch vertical spacing. In the drawings and description provided herein, the different bracket plates 16*a*, 16*b* are designated by the same reference numerals regardless of size. However, as can be seen with reference to FIGS. 4-6, it should be noted that pivot pins 26 are received in a different (lower) position on seatback brackets 24 when decreased-height bracket plates are used.

Figure 4:
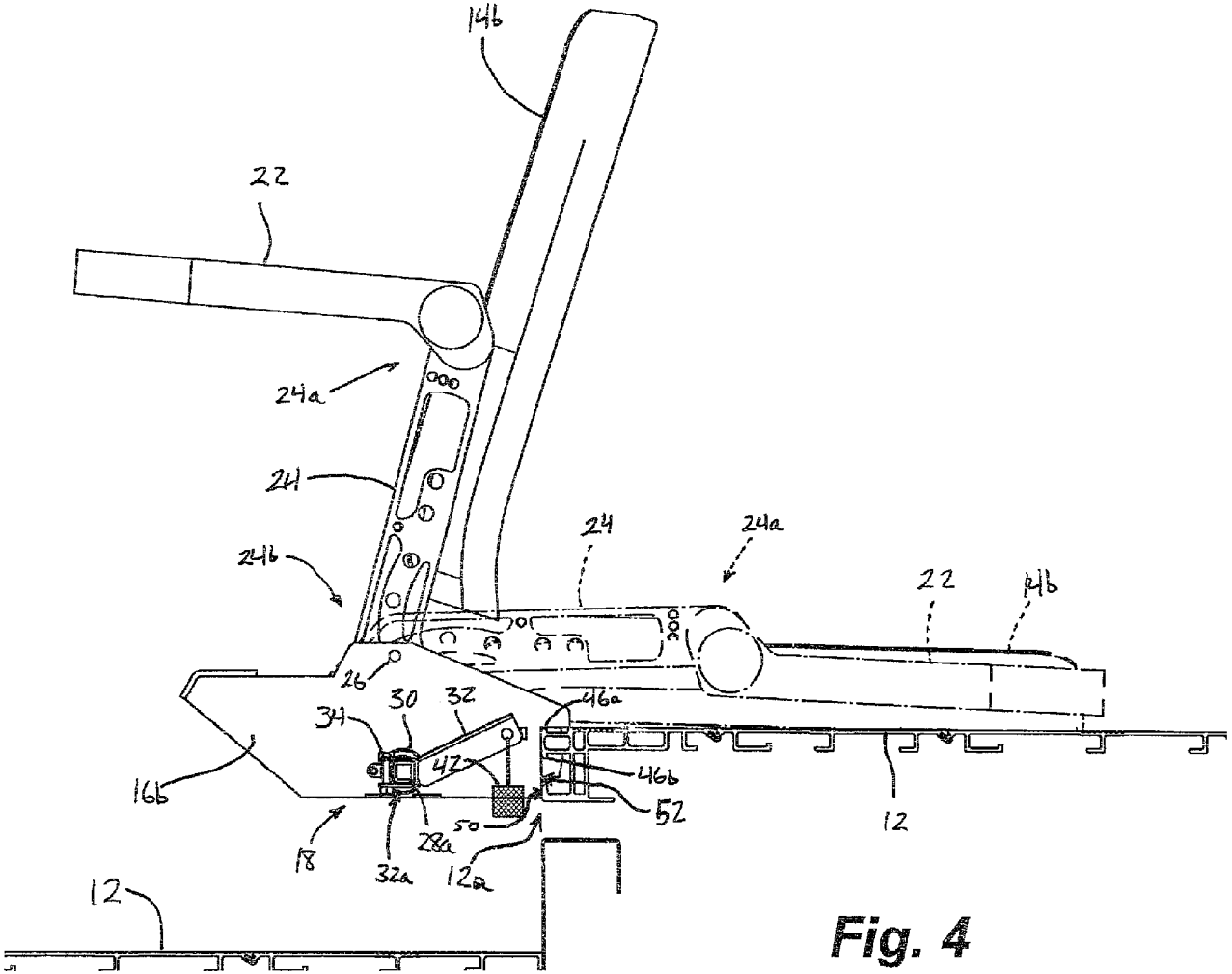
FIG. 4 is a side elevation of a bleacher seat at the end of a row of seating, shown with the back portion in a raised configuration, and with the back portion in a lowered configuration shown in phantom.

Seat back portions 14*b* generally move together with seatback brackets 24 so that seat back portions 14*b* and seatback brackets 24 can be moved together between the raised use configuration and the lowered storage configuration, such as shown in FIG. 4. However, it will be appreciated that seat back portions 14*b* may be at least somewhat movable relative to seatback brackets 24, such as to adjust the recline angle of back portion 14*b* in the raised use configuration, such as shown in FIG. 8. For example, spaced holes 29 may be provided in upper end portion 24*a* of seatback bracket 24 for selectively receiving a pin (such as a spring-loaded pin) that extends outwardly from the side of seat back portion 14*b*, to permit adjustment of the recline angle of back portion 14*b* to a desired or appropriate angle.

Release mechanism 18 includes an elongate actuator bar or rod 28 that extends along an entire row of seats 14 (or portion of a row, such as along two or four or six or twelve seats, or more or less depending on the particular application of the seating system), and that is rotatably supported in respective apertures 30 formed in bracket plates 16*a*, 16*b* (FIGS. 1-4, 7 and 8). In the illustrated embodiment, actuator bar 28 comprises a 0.75-inch square tube to which a plurality of generally L-shaped release members 36 is mounted. Release members 36 are supported in respective bearings or bushings located in apertures 30, which facilitate rotation of the actuator bar 28 and release members 36 relative to the bracket plates 16*a*, 16*b*. As best shown in FIGS. 2-4 and 8, actuator bar 28 includes an end portion 28*a* that extends outwardly from the bracket assembly 16 located at the aisle end of a given row of seats 14. End portion 28*a* receives an actuator lever 32 that may be attached or clamped thereon via a fastener 34 (FIGS. 1, 4 and 8). Actuator lever 32 includes a bar-receiving portion 32*a* having a non-circular shape that generally corresponds to the shape of actuator bar 28 so that bar-receiving portion 32*a* can be readily attached or clamped to actuator bar end portion 28*a* using fastener 34, and so that actuator lever 32 moves with the actuator bar 28. Actuator lever 32 is positioned close to deck 12 and is angled above the deck when release members 36 are in the locked position (FIGS. 1-4, 6 and 9) so that an operator can step on or otherwise actuate or move the lever 32 to move the release member 36 to the unlocked position (FIGS. 7 and 8).

The L-shaped release members 36 may be spaced along actuator bar 28 at any suitable or selected or desired spacing intervals (to configure the seating assembly for seats having a selected or desired width or size dimension) and positioned between bracket plates 16*a*, 16*b* (which may also be spaced along the bar at any suitable or selected or desired spacing), below respective seatback brackets 24. Thus, release members 36 and bracket assemblies 16 may be positioned along actuator bar 28 at substantially any spacing that corresponds to the selected width or widths or size dimensions of the seats that are positioned along a given seating row. Release members 36 include non-circular openings or apertures that generally correspond to the shape of actuator bar 28 so that the release members 36 rotate with actuator bar 28. Release members 36 have locking projections 38 that are spaced outwardly or extend radially from actuator bar 28, and which move along an arcuate path between a locking or engaging position (FIGS. 1 and 5) and an unlocking or disengaging position (FIG. 7). In the locking or engaging position of FIGS. 1 and 5, locking projections 38 are received in recesses 27 of the respective seatback brackets 24 to limit relative movement of seatback brackets 24 and bracket plates 16*a*, 16*b*. In the unlocking or disengaging position of FIG. 7, the locking projections 38 are removed from recesses 27 to thereby permit rotation of seatback brackets 24 about pivot pins 26. It will be appreciated that recesses 27 and locking projections 38 are just one set of corresponding locking elements that can selectively engage one other to limit or preclude pivoting movement of seatback brackets 24 relative to bracket assembly 16. Other types of suitable corresponding locking elements may include, for example, rotary-actuated clutch elements, cam devices, a recess on the release member for receiving a projection on the seatback bracket, or the like.

In the illustrated embodiment, each seatback bracket 24 is lockable with the seat in its upright position and releasable via a respective release member 36, so that all seatback brackets 24 in a given row of seats 14 are simultaneously or substantially simultaneously lockable and releasable via rotation of actuator bar 28. When actuator bar 28 and release members 36 are in their unlocking position, seatback brackets 24 and seat back portions 14*b* may be pivoted rearwardly to a substantially flat horizontal storage configuration along the deck 12 to which seats 14 are mounted, such as shown in FIGS. 4 and 9. Once release members 36 are moved sufficiently to disengage recesses 27 in the seatback brackets 24, seatback brackets 24 and seat back portions 14*b* may simply fall backwards toward the low-profile storage configuration under the weight of gravity, or may be urged backwards by the operator or by a powered raising/lowering actuator, for example.

Optionally, a friction or clutch or damper system may be provided to slow or control the lowering movement of seatback brackets 24 and seat back portions 14*b* to the storage position, to limit or prevent the seat back portions 14*b* from impacting deck 12 at high speed. For example, and with reference to FIGS. 10 and 11, a damper and lift-assist device 58 is positioned between seatback bracket 24 and seat mounting bracket 16, and generally rearward of seatback bracket 24. Damper and lift-assist device 58 includes a first end portion 58*a* pivotably coupled to seatback bracket 24 at a location spaced below pivot pin 26, and a second end portion 58*b* that is pivotably coupled to seat mounting bracket 16 near deck clamp 20. Damper and lift-assist device 58 may be linearly biased toward a retracted position so that its biasing force urges seatback bracket 24 away from the flat horizontal storage configuration (such as shown in FIG. 9) toward the upright locked position of FIG. 10 and/or toward the fully upright (unlocked) position of FIG. 11. Damper and lift-assist device 58 may also provide a damping function to slow the rearward fall of seatback brackets 24 and seat back portions 14*b* as they move toward the flat horizontal storage configuration following release of the release mechanism 18 by an operator.

Damper and lift-assist device 58 may be a gas-charged strut or a linear spring damper that provides both a damping function and a biasing function. The biasing force of damper and lift-assist device 58 may be sufficient to slow the descent of seatback brackets 24 and seat back portions 14*b* as they move toward the flat horizontal storage configuration, and to reduce the force required to later raise the seatback brackets 24 and seat back portions 14*b* from the flat horizontal storage configuration to a raised position. Optionally, a device that provides only a damping effect or only a lift-assist effect may be used in place of a combination damper and lift-assist device, and it will be appreciated that a device providing only lift-assist would be at least somewhat effective in slowing the fall of seatback brackets 24 and seat back portions 14*b* toward the flat horizontal storage configuration.

It will further be appreciated that a damper and lift-assist device which is linearly biased toward an expanded or extended position may be used with similar effect as damper and lift-assist device 58. This may be accomplished by positioning the extension-biased device at a different location in the mechanism. For example, and with reference to FIG. 12, an extension-biased damper and lift-assist device 60 is positioned generally forward of seatback bracket 24, with a first end portion 60*a* pivotally coupled to lower end portion 24*b* of seatback bracket 24 (between pivot pin 26 and recess 27), and a second end portion 60*b* pivotally coupled to a forward portion of seat mounting bracket 16. In this arrangement, extension-biased damper and lift-assist device 60 can provide substantially the same function as device 58, and may be particularly suited for use with increased-height bracket plates as shown in FIGS. 1 and 7-11; whereas device 58 may be better suited for use with reduced-height bracket plates as shown in FIGS. 2-6 and 12, in which there is less vertical space available, making it advantageous to mount device 60 in a substantially horizontal orientation. Optionally, it is envisioned that a more compact rotary biasing and/or damping mechanism may be used at pivot pin 26, instead of the linear devices 58, 60 described above.

When the seat back portions 14*b* are in their storage configuration, they may be unlocked so that the seat backs and release members and actuator bar may be pivoted to pivot the seat back portions 14*b* to their upright position without first having to operate or actuate the actuation lever 32. Optionally, actuator bar 28 or release members 36 or actuator lever 32 are biased, such as with a spring 62 (FIGS. 11 and 12) or other actuator or biasing element, to rotate toward the locking configuration so that projection 38 automatically engages recess 27 when these elements align with one another. This allows for automatic locking of the seatbacks when being raised from the unlocked storage position to the raised use position, and prevents the seatbacks from falling to the storage position when being pivoted rearwardly from the substantially vertical position of FIG. 7, for example, without need for an operator to manipulate actuator lever 32.

Optionally, seatback brackets 24 and seat back portions 14*b* may be pivoted at least somewhat forwardly, such as to the substantially vertical position of FIG. 7, when actuator bar 28 and release members 36 are moved to the unlocking position. With seat back portions 14*b* in the substantially vertical position, persons standing on deck 12 are provided with greater surface area on which to stand or walk. In addition, an optional support railing 40 may be fixedly attached to deck 12 near the front edge portion 12*a* when seat back portion 14*b* is substantially vertical, so that persons standing on deck 12 can stabilize themselves by grasping or leaning on railing 40.

Optionally, the respective shapes or geometries of recess 27 and projection 38 may permit seatback brackets 24 and seat back portions 14*b* to be pivoted forward, as in FIG. 7, without manually rotating actuator bar 28 and release members 36 via actuator lever 32. Instead, the geometries of recess 27 and projection 38 allow projection 38 to be displaced out of recess 27 when lower end portion 24*b* of seatback bracket 24 moves rearwardly (i.e. as upper portion 24*a* moves forwardly, pivoting about pivot pin 26). This geometry would still lock when the seat backs are urged in the opposite direction, to prevent projection 38 from being displaced out of recess 27 when lower end portion 24*b* of seatback bracket 24 moves forwardly, such as due to a person leaning back against back portion 14*b* of seat 14.

Thus, a single operator located in an aisle of bleacher seating system 10 can unlock or release some or multiple or all of the seatback brackets 24 and seat back portions 14*b* in a given row of seats 14, simply by depressing actuator lever 32 to thereby rotate actuator bar 28 and release members 36 from the locking/engaging position to the unlocking/disengaging position. Optionally, a cover (not shown) may be attached to the outermost aisle-side bracket plate 16*b* to cover release mechanism 18, including actuator lever 32, to prevent inadvertent or accidental rotation of actuator bar 28.

Optionally, an actuator 42 (FIG. 4) may be coupled to actuator lever 32 so that the lever can be actuated remotely by an operator. Actuator 42 may further be coupled to one or both bracket plates 16*a*, 16*b*, and may comprise any suitable actuator, such as a linear or rotary actuator, such as, for example, a single-acting or double-acting electrical, hydraulic, or pneumatic actuator, while remaining within the spirit and scope of the present invention. It will be appreciated that other types of powered actuators, such as rotary actuators, may be used without departing from the spirit and scope of the present invention. Thus, by providing an actuator 42 at each actuator lever 32 for each row of seats 14 in the bleacher seating system 10, an operator can simultaneously or sequentially unlock all of the seatback brackets 24 for the entire bleacher seating system, such as via a remote controller. Optionally, actuator 42 may be configured so that it can be overridden by manually actuating lever 32.

Figure 5:
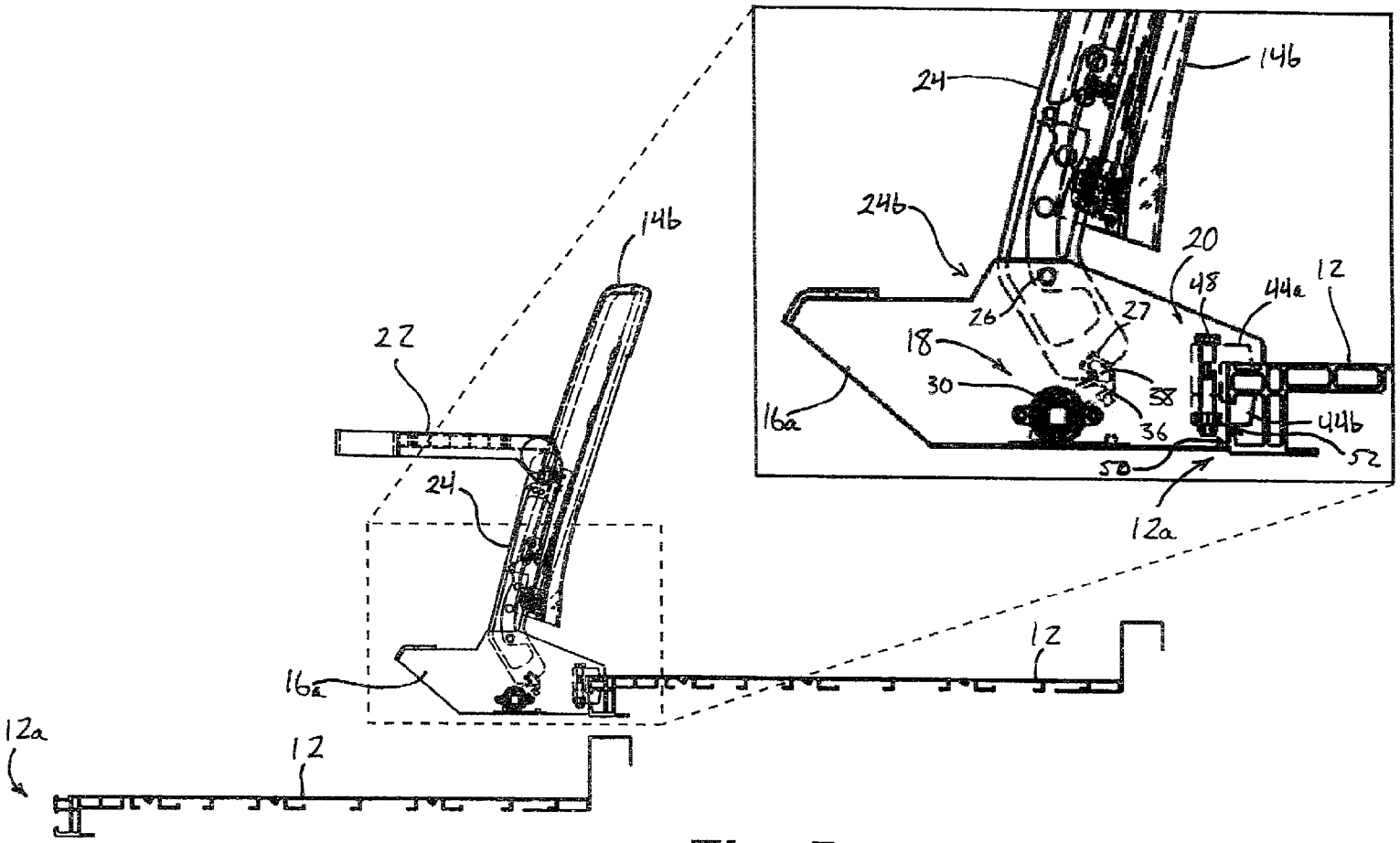
FIG. 5 is a side elevation of another seat in which the back portion is raised and locked, including an enlarged view of the seat mounting and seatback release mechanism.
Figure 6:
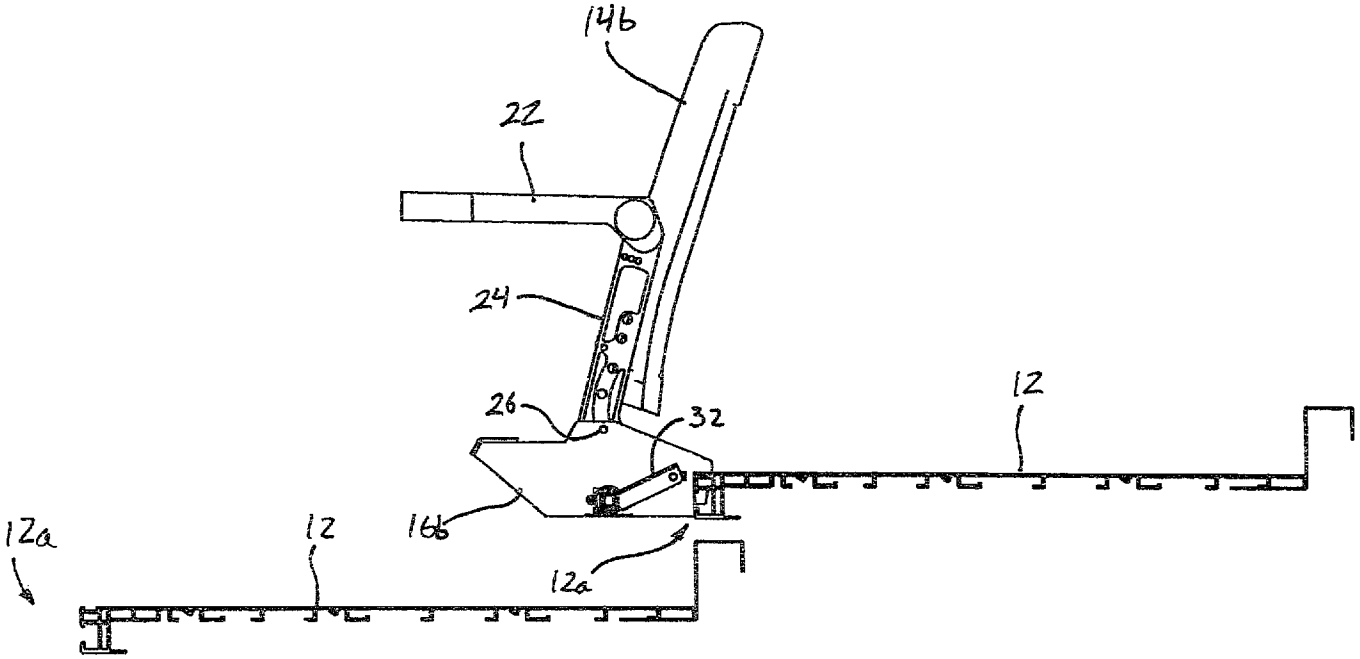
FIG. 6 is another side elevation of an end seat mounted to a deck, and positioned above another deck.

As best shown in FIGS. 1, 5 and 7, seat mounting bracket assemblies 16 are secured to front edge portion 12*a* of deck 12 via deck clamps 20, which are positioned between corresponding pairs of bracket plates 16*a*, 16*b*. In the illustrated embodiment, front edge portion 12*a* of deck 12 includes an upper lip or flange 46*a* and a lower lip or flange 46*b* (FIGS. 1, 4 and 8), each of which is engaged by a respective upper portion 44*a* or lower portion 44*b* of each deck clamp 20. Deck clamp 20 is generally C-shaped, with upper clamp portion 44*a* joined to lower clamp portion 44*b* via a clamp fastener 48. Upper and lower portions 44*a*, 44*b* of deck clamp 20 cooperate to form jaws that clamp onto front edge portion 12*a* of deck 12 and engage the upper and lower flanges 46*a*, 46*b* (respectively) when fastener 48 is tightened. Deck clamp 20 cannot be pulled forwardly off of forward end portion 12*a* of deck 12 until fastener 48 has been loosened to the extent that the clamp portions can be sufficiently separated to disengage the respective flanges.

Upper clamp portion 44*a* may be fixedly attached to seat bracket plates 16*a*, 16*b*, such as by welding or with mechanical fasteners or the like, with lower clamp portion 44*b* permitted to slide between the bracket plates during installation or removal. Upper clamp portion 44*a* includes an alignment projection 54 (FIG. 1) on either side of the clamp portion for engaging respective alignment apertures 56 (FIG. 8) in seat bracket plates 16*a*, 16*b*. Deck clamp 20 can thus be readily aligned in bracket assembly 16 with alignment projections 54 received in mounting apertures 56, whereby each bracket assembly 16 is properly aligned for receiving actuator bar 28 and for attaching clamps 20 to the front end or nose portion 12*a* of deck 12.

Deck clamp 20 can be positioned and/or repositioned substantially anywhere along front edge portion 12*a* of deck 12, and thus does not require drilling holes through deck 12, as is common for bolt-on seating. Thus, as with the above-described ability to position release members 36 (and, thus, seat bracket assemblies 16) substantially anywhere along actuator bar, deck clamps 20 also permit seat bracket assemblies 16 to be attached substantially anywhere along front edge portion 12*a* of deck 12. This adaptability for positioning seat bracket assemblies 16 in substantially any desired location or spacing, without modification to deck 12 or any of the seat hardware, facilitates the installation of seats 14 having substantially any selected or desired width or spacing along a row. Seats of differing widths or spacing can also be installed within a row, and can still be released and locked by release mechanism 18 and mounted to deck 12 in the same manner as if all seats were the same width and/or arranged at equal spacing.

Optionally, front edge portion 12*a* of deck 12 further includes a forward-facing abutment surface 50 that is spaced below upper and lower flanges 46*a*, 46*b*, and which is engaged by a rearward-facing abutment surface 52 of each bracket plate 16*a*, 16*b*, such as shown in FIGS. 1, 4, 5, 7 and 8. With bracket assemblies 16 installed at front edge portion 12*a* of deck 12 and secured with deck clamps 20, rearward-facing abutment surface 52 rests against forward-facing abutment surface 50 to substantially limit or prevent flexing or pivoting movement of bracket assemblies 16 relative to deck 12. The engagement of abutment surfaces 50, 52 reduces the bending moment applied to front edge portion 12*a* where deck clamps 20 are mounted, and distributes a portion of the seating loads to the deck structure that forms and supports front-facing abutment surface 50.

Thus, the bleacher seating system of the present invention facilitates rapid simultaneous repositioning of the seat back portions in each row of seating to aid in setting up and collapsing sets of seating rows, and allows for increased walking space and a particularly compact seating storage configuration. This is accomplished via a release mechanism that may be actuated to simultaneously unlock all seat back portions in a row from a single location, and via nosemount deck clamps that couple the seating rows to the front edge or nose portions of respective decks. Thus, a gang or group of seats or chairs in a row may be joined and/or controlled together via a continuous tube or rod with a single actuator at one location at the tube or rod, such as at the end of the continuous tube at an end of the row of seats or chairs, such as at an aisle of a seating assembly or system. The bleacher seating system thus may be readily set up or collapsed a single operator, such as by manually or remotely unlocking and locking the seat back portions in rows so that the seat backs may be pivoted between raised and lowered positions.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A bleacher seating system comprising:

a generally planar deck having a forward edge portion, said forward edge portion comprising an upper flange projecting upwardly from an adjacent surface of said forward edge portion and a lower flange projecting downwardly from an adjacent surface of said forward edge portion;

a plurality of seat mounting brackets coupled to said forward edge portion of said deck;

a plurality of seats arranged in a row and coupled to said forward edge portion of said deck via said seat mounting brackets;

a generally C-shaped deck clamp at each of said seat mounting brackets, said deck clamp having two clamp portions joined by a fastener and configured to releasably engage said forward edge portion of said deck, wherein said deck clamp is securable onto said forward edge portion of said deck via tightening of said fastener when said forward edge portion of said deck, including said upper and lower flanges, is received at least partially between said clamp portions; and wherein said plurality of seats is supported at said forward edge portion of said deck via said deck clamps.

2. The bleacher seating system of claim 1, wherein said forward edge portion of said deck further comprises a forward-facing abutment surface positioned below said upper and lower flanges, and wherein each of said seat mounting brackets comprises a rearward-facing abutment surface that engages said forward-facing abutment surface of said deck to limit or prevent pivoting movement of said seat brackets relative to said deck.

3. The bleacher seating system of claim 1, further comprising:

a seatback bracket configured to pivotably couple a back portion of each of said plurality of said seats to respective ones of said seat mounting brackets, said seatback brackets being movable between an upright use position and a collapsed storage position; and dampers coupled between said seat mounting brackets and said seatback brackets for slowing a downward pivoting movement of said seatback brackets toward the collapsed storage position.

4. The bleacher seating system of claim 3, further comprising at least one biasing element for biasing said seatback brackets away from the collapsed storage position.

5. A bleacher seating system comprising:

a deck having a forward edge portion including an upward facing surface, a downward facing surface, and a forward facing surface between said upward and downward facing surfaces;

a plurality of seats arranged in a row and coupled to said deck via seat mounting brackets, each of said seats including a seat portion and a back portion that is pivotable between an upright use position and a collapsed storage position;

a generally C-shaped deck clamp at each of said seat mounting brackets, said deck clamp having two clamp portions joined by a fastener and configured to releasably engage said forward edge portion of said deck, wherein said deck clamp is securable onto said forward edge portion of said deck via tightening of said fastener when said forward edge portion of said deck, including each of said upward facing surface, said downward facing surface, and said forward facing surface, is received at least partially between said clamp portions;

an elongate actuator bar extending between and rotatably supported at said seat mounting brackets;

a seatback bracket pivotably coupling said back portion of each of said seats to respective ones of said seat mounting brackets, each of said seatback brackets having a pivot-lock element;

a plurality of release members coupled to and extending from said actuator bar for rotation with said actuator bar, said release members generally aligned with respective ones of said seatback brackets; and wherein said actuator bar and said release members are rotatable between a locking position in which said release members engage respective ones of said pivot-lock elements to limit or prevent pivoting movement of said seatback brackets when said back portions are in the use position, and an unlocking position in which said release members disengage said pivot-lock elements to permit pivoting movement of said seatback brackets and said back portions to the collapsed storage position.

6. The bleacher seating system of claim 5, wherein said forward edge portion of said deck comprises a forward-facing abutment surface below said forward facing surface, and said seat mounting brackets each comprise a rearward-facing abutment surface below said deck clamp and configured to engage said forward-facing abutment surface.

7. The bleacher seating system of claim 5, wherein said pivot-lock elements of said seatback brackets comprise recesses, and said release members comprise projections for engaging said recesses in said locking position.

8. The bleacher seating system of claim 7, wherein said release members comprise generally L-shaped members.

9. The bleacher seating system of claim 5, further comprising an actuator lever coupled to and extending outwardly from an end portion of said elongate actuator bar, wherein said elongate actuator bar and said release members are rotatable together via actuation of said actuator lever.

10. The bleacher seating system of claim 9, further comprising a powered actuator coupled to said actuator lever, wherein said powered actuator is selectively operable to actuate said actuator lever to thereby rotate said elongate actuator bar and said release members.

11. The bleacher seating system of claim 5, wherein said elongate actuator bar is rotatably supported in respective bores in said seat mounting brackets.

12. The bleacher seating system of claim 11, wherein one of said release members is positioned along said elongate actuator bar at each of said seat mounting brackets for selectively engaging each of said seatback brackets.

13. The bleacher seating system of claim 5, wherein said seat back portions are configured to pivot downwardly to the collapsed storage position due to gravity when said release members are rotated to the unlocking position to disengage said pivot-lock elements.

14. The bleacher seating system of claim 13, further comprising dampers at said seatback brackets for controlling the downward pivoting movement of said seat back portions.

15. The bleacher seating system of claim 14, further comprising a biasing element at said seatback bracket for biasing said seat back portions away from the collapsed storage position.

16. The bleacher seating system of claim 5, wherein said deck clamps and said seating mounting brackets are positionable at substantially any spacing along said actuator bar.

17. A bleacher seating system comprising:

a generally planar deck having a forward edge portion, said forward edge portion comprising upper and lower flanges that project upwardly and downwardly in opposite directions from one another;

a plurality of seat mounting brackets coupled to said forward edge portion of said deck;

a plurality of seats arranged in a row and coupled to said forward edge portion of said deck via said seat mounting brackets, said seats comprising seat portions and seat back portions;

a generally C-shaped deck clamp at each of said seat mounting brackets, said deck clamps each having an upper clamp portion configured to extend above and engage said upper flange portion, and a lower clamp portion configured to extend below and engage said lower flange, and a fastener joining said upper clamp portion and said lower clamp portion; and wherein said deck clamps are configured to secure said seats to said forward edge portion of said deck, whereby said seat portions are positioned entirely forward of said forward edge portion of said generally planar deck.

18. The bleacher seating system of claim 17, wherein said upper and lower clamp portions of said deck clamps are moveable relative to one another and are joined by a fastener, and wherein said deck clamps are securable onto said forward edge portion of said deck via tightening of said fasteners when said forward edge portion of said deck, including said upper and lower flanges, is received at least partially between respective pairs of said upper and lower clamp portions.

19. The bleacher seating system of claim 17, further comprising:

a seatback bracket configured to pivotably couple a back portion of each of said plurality of said seats to respective ones of said seat mounting brackets, said seatback brackets being movable between an upright use position and a collapsed storage position; and dampers coupled between said seat mounting brackets and said seatback brackets for slowing a downward pivoting movement of said seatback brackets toward the collapsed storage position.

20. The bleacher seating system of claim 17, wherein said forward edge portion comprises a forward-facing abutment surface below said lower flange, and said seat mounting brackets each comprise a rearward-facing abutment surface below said deck clamp and configured to engage said forward-facing abutment surface.

* * * * *